United States Patent [19]

Klesius

[11] Patent Number: 5,004,126

[45] Date of Patent: Apr. 2, 1991

[54] PLASTIC CLOSURE FOR A PLASTIC CONTAINER

[76] Inventor: Konrad Klesius, Maria-Oberndorf-Strasse 5, 6501 Bodenheim, Fed. Rep. of Germany

[21] Appl. No.: 241,651

[22] Filed: Sep. 8, 1988

[30] Foreign Application Priority Data

Sep. 9, 1987 [DE] Fed. Rep. of Germany ..... 3730225

[51] Int. Cl.[5] ..... B67B 5/00

[52] U.S. Cl. ..... 222/153; 222/529; 215/256

[58] Field of Search ..... 222/153, 541, 542, 530, 222/527, 528, 529, 539; 215/256, 253, 254

[56] References Cited

U.S. PATENT DOCUMENTS

| | | | |
|---|---|---|---|
| 3,489,319 | 1/1970 | Marcel | 222/153 |
| 3,817,416 | 6/1974 | Costa | 215/256 |
| 4,261,478 | 4/1981 | Summers | 215/256 |
| 4,320,843 | 3/1982 | Dubach | 215/256 |
| 4,422,563 | 12/1983 | Babiol | 222/529 |
| 4,478,242 | 10/1984 | Bond | 222/153 |
| 4,569,464 | 2/1986 | Wassilieff | 222/529 |
| 4,760,941 | 8/1988 | Salmon et al. | 222/153 |
| 4,773,560 | 9/1988 | Kittscher | 222/153 |
| 4,796,769 | 1/1989 | Obadia | 215/256 |

*Primary Examiner*—Robert P. Olszewski
*Assistant Examiner*—Kenneth Noland

[57] ABSTRACT

The specification describes a plastic closure adapted to be screwed onto the neck (1) of a plastic container, with a screw-on ring (5) and with an insert portion (11) comprising a flexible bellows (14) and a pour spout (15), with a frame cap (21) adapted to be screwed on to an external thread (19) on the spout. In order to maintain good pouring properties, e.g. by means of the flexible bellows, and to make automatic production simpler and cheaper, the invention proposes that the frame cap (21) is integral with the screw-on ring (5), and the top wall (23) of the cap (21) is moulded on so that it projects a distance (d) from the top wall (8) of the ring (5).

18 Claims, 4 Drawing Sheets

PLASTIC CLOSURE FOR A PLASTIC CONTAINER

The invention relates to a plastic closure adapted to be screwed onto the neck of a plastic container, with a screw-on ring and with an insert portion comprising a flexible bellows and a pour spout, with a frame cap adapted to be screwed on to an external thread on the spout, characterised in that the frame cap is integral with the screw-on ring, and the top wall of the cap is moulded on so that it projects a distance (d) from the top wall of the ring.

Many types of plastic closures are already known for sealing plastic cans. The simplest construction is a screw-on cap which can be screwed on to an external thread on the neck of the can, and which is unscrewed by the user so that, for example, liquid contents can be emptied directly through the neck. The contents cannot be well directed when poured out, and there is unpleasant glugging noise during the pouring process. Consequently some of the contents are spilt, which is undesirable according to the type of material. In addition end seals also have to be fitted to ensure tightness, particularly with products which tend to creep, thus making the price of the closure a problem to the producer.

As a means of improving pouring, it is known to provide a plastic closure with a flexible bellows which can be sealed by a frame cap and which is adapted to be screwed onto the neck of the can by means of a screw cap. This construction has the disadvantage of being in three parts. It is therefore very expensive for the manufacturer. With some filling materials an additional sealing washer again has to be inserted to ensure that the closed can is properly sealed, thereby further increasing the cost.

Another known plastic closure is inserted internally adjacent the web of a specially constructed neck rim and is welded to the web at its periphery. Hence when the container is sealed for the first time it can be guaranteed to be fluid tight, but manufacture is generally excessively expensive and only justified in special cases, e.g. if the hardness and melting temperature of the plastic of the container are different from those of the closure. However, the known closure provides no solution for cheap mass production of normal plastic closures.

In other plastic closures with a flexible bellows, the insert portion with the flexible bellows and pour spout is fixed by a metal holding ring engaging over and round it, instead of being welded. A good security closure can be obtained in this way and tightness is ensured, but the expense of the separate holding ring on the end face of the neck of the container can only be recommended for special embodiments. Cheap mass production of closures for normal necks of cans with an external thread in the form of a screw-on cap cannot be obtained from this model.

For this reason manufacturers of plastic closures have already started reducing the number of components, and have particularly started combining the screw-on cap and insert portion with the flexible bellows into one piece, so that only the frame cap has to be made separately and screwed to the external thread on the spout. However, the disadvantage of these known screw-on closures is the complicated and time consuming production of the parts combining the bellows and the screw-on cap, and a further disadvantage is that a plastic which is soft enough for the operation and folding of the bellows has to be used. On the other hand this plastic is unsuitable for the screw-on cap, which must have good strength and stability so that it can firstly ensure a strong screw closure and secondly enable a security closure to be fitted. So the manufacturer has gone over to providing this single part with thicker walls in the region of the screw-on cap. However, this makes the curing time and the dwell time in the mould excessively long. The greater thickness of the walls to achieve the necessary rigidity and stability has the disadvantage of reducing the sealing function, with the result that sealing rings have to be inserted again so that cans of liquid can really be sealed tight by the closure.

The invention aims further to develop the plastic closure of the above type, so that automatic production becomes simpler and cheaper while good pouring properties are maintained, e.g. by means of the flexible bellows.

According to the invention, this aim is achieved in that the frame cap is integral with the screw-on ring, and the top wall of the cap is moulded on so that it projects a distance (d) from the top wall of the ring. The invention surprisingly goes a different way from the last manufacturer described, for instead of combining the insert portion comprising the flexible bellows with the screw-on ring, it combines the screw-on ring with the frame cap. Consequently the rigid and fixed parts of the plastic closure may advantageously be made of one material and with appropriately thick walls, while the insert portion with the flexible bellows and possibly even sealing components mounted thereon, may be made of softer plastic, possibly with thinner walls.

One could take the view that the production of a three part closure could be simplified by combining either a first group of two parts or a second group of two with the respective third part into one piece. That is to say, one might think that a person skilled in the art, on finding disadvantages in known closures, would automatically try to combine the frame cap and screw-on ring into one piece in manufacture. However, there are considerable objections to this, namely that, for the frame cap to be moved relative to the screw-on ring, the frames have to be accessible to the user without any special tools being used. In other words, the person skilled in the art has to provide unknown means in the top wall of the screw-on ring, in order to take hold of the frames of the cap on that level. But such means, e.g. recesses or holding aids, are hardly conceivable.

The way the invention has overcome these objections is to provide a spacing between the top wall of the screw-on ring and the top wall of the frame cap, so that the cap projects some distance from the screw-on ring. This is a surprisingly simple way of ensuring that the frames, which are only joined to the top wall of the cap at certain points, are exposed and accessible to the user so that he can open the can without a tool.

By the inventive measures explained above, the insert portion with the flexible bellows is retained in the novel plastic closure in order to maintain the known good pouring properties, and production with at least partly automatic machines can be made simpler and cheaper. The plastic closures are generally mass produced articles, so even minor simplifications have a great effect on automatic production.

The user of the frame cap will obviously pull the flexible bellows out of the region inside the screw-on ring in order to open the can, and then unscrew it from the insert portion with the spout, so that he can then take hold of the tab for pulling out the security seal and thus correctly open the pack in the usual way.

The novel closure of the invention allows for a security closure, for it is known that simple security rings may be provided with a security strip externally at the bottom adjacent to the area where the neck joins onto the can. As the screw-on ring may be advantageously be made of hard plastic, in certain cases with thicker walls, it has adequate rigidity, so that even undesirable manipulations do not take place without visible damage or are avoided, with the container provided with the new closure providing reliable sealing security.

Further according to the invention, the frame cap is advantageously joined to the screw-on ring by a tear strip. If the ring and cap are produced as a single moulding, the ordinary production expert considering such a combination of two parts in a single moulding will have doubts as to how the cap can be moved relative to the ring if the two components are integral. If a predetermined breaking location is arranged in defined areas between the two parts, e.g. in the form of a tear strip though, it will be obvious to the user that he can pull up the cap to pull out the flexible bellows in opening the closure, so that the cap is then separated and can be turned relative to the ring.

The top wall of the cap can be arranged in one, external plane and the top wall of the ring in the other, internal plane, with the two planes spaced from one another, in a particularly appropriate way if, according to the invention, the top wall of the ring is provided with at least one raised, outwardly protruding retaining piece of a height approximately equal to the distance to the top wall of the cap. Here it may be sufficient to mount one securing piece in the ring, but it is desirable to mount at least two, thereby forming a plastic component with adequate stability, where the user will immediately see the freely accessible frames which he operates to open the container.

In accordance with the invention, it is particularly appropriate for the retaining piece to be shaped as a segment of a circle in plan. The screw-on ring itself may be thought of as consisting of the cylindrical surface with screw thread on the inside and possible ribbing on the outside, a free aperture being left inwardly towards the center of the container, and the annular top wall adjoining the top outer periphery and also having a circular aperture in the center. The retaining piece should be thought of as being moulded along part of this circle; its cross-section is similar to that of the ring itself, although the measurements and proportions are different. In plan at any event the retaining piece may appropriately be shaped as a segment of a circle.

In cross-section there is again an L-shape, i.e. the part cylinder is adjoined by a segment of a circle located at the same level as the top wall of the cap. It is desirable for the transition from the segment of the circle to the top wall of the cap to be provided by the tear strips. The invention therefore proposes that two diametrically opposed, arcuate retaining pieces should be moulded onto the ring, and the tear strips should extend radially inwards from the retaining pieces, following their curvature. Hence with two arcuate retaining pieces opposite one another there will be two appropriately arcuate tear strips, so that the top wall of the cap is between them. It has been found in practice that when the frames, which are also joined on in the region of the retaining pieces, have been bent upwards there is no difficulty in pulling and tearing the tear strips to initiate the opening process, i.e. to pull out the flexible bellows by means of the frames.

It is further appropriate, according to the invention, for a sealing flange to be moulded onto the insert portion at the side of the flexible bellows opposite the pour spout. It has been mentioned several times that sealing is often a problem if the filling materials are liable to creep. In order to avoid separate sealing washers or rubber rings which have to be inserted additionally in a separate opeation, the invention proposes that the insert portion should be made of soft and resilient enough plastic with appropriately thin sealing flanges, thereby advantageously dispensing with the insertion of an additional seal. In the closure proposed here the sealing flange has a favourable, circular shape and can be laid on the annular surface of the neck of the container at the end and wedge on the ring there.

Should such a seal not be sufficient, a sealing cone may additionally be provided on the sealing flange in a further advantageous embodiment of the invention. Whereas the flange extends parallel with the plane of the top walls, the cone extends perpendicular thereto, in the axial direction of the neck of the container. The cone is also annular and is at a distance from the outer end of the flange such that it comes to rest on the inside of the neck in a good wedging position.

The end face of the neck of the container may be scratched or otherwise damaged from time to time in production, or there may be sink marks. Even if the flange on the insert portion provides a good seal, very slight leakages may occur, but these can be avoided if the cone is additionally provided. The cone virtually gives a double seal in the region of the annular top outer end of the neck.

A further improvement in the seal at the other end of the neck can be provided, according to the invention, if an annular projection is additionally mounted on the surface of the flange facing towards the neck. The projection, for example, could be mid way between the circular outer edge of the flange and the joining edge adjacent the cone. As seen in cross-section, it may be triangular, circular, toric, polygonal or the like. An annular projection may be moulded to the sealing flange with simple means in one and the same moulding machine during the moulding of the insert portion.

The closure according to the invention can not only maintain good pouring properties, particularly by means of the flexible bellows, but also make automatic production simpler and cheaper, for example by combining two of the three parts, namely the screw-on ring and the frame cap, into one. A satisfactory seal can be created at the same time, since the insert portion is made of softer plastic with thinner walls and may be provided with sealing means (sealing flange, sealing cone, thread, etc.) in the appropriate places.

A closure of this type can be screwed onto normal container necks and gives a secure pack, since security strips or the like can readily be fitted.

Other advantages, features and applications of the invention will emerge from the following description of preferred examples. These refer to the accompanying drawings, in which.

Figure 1:
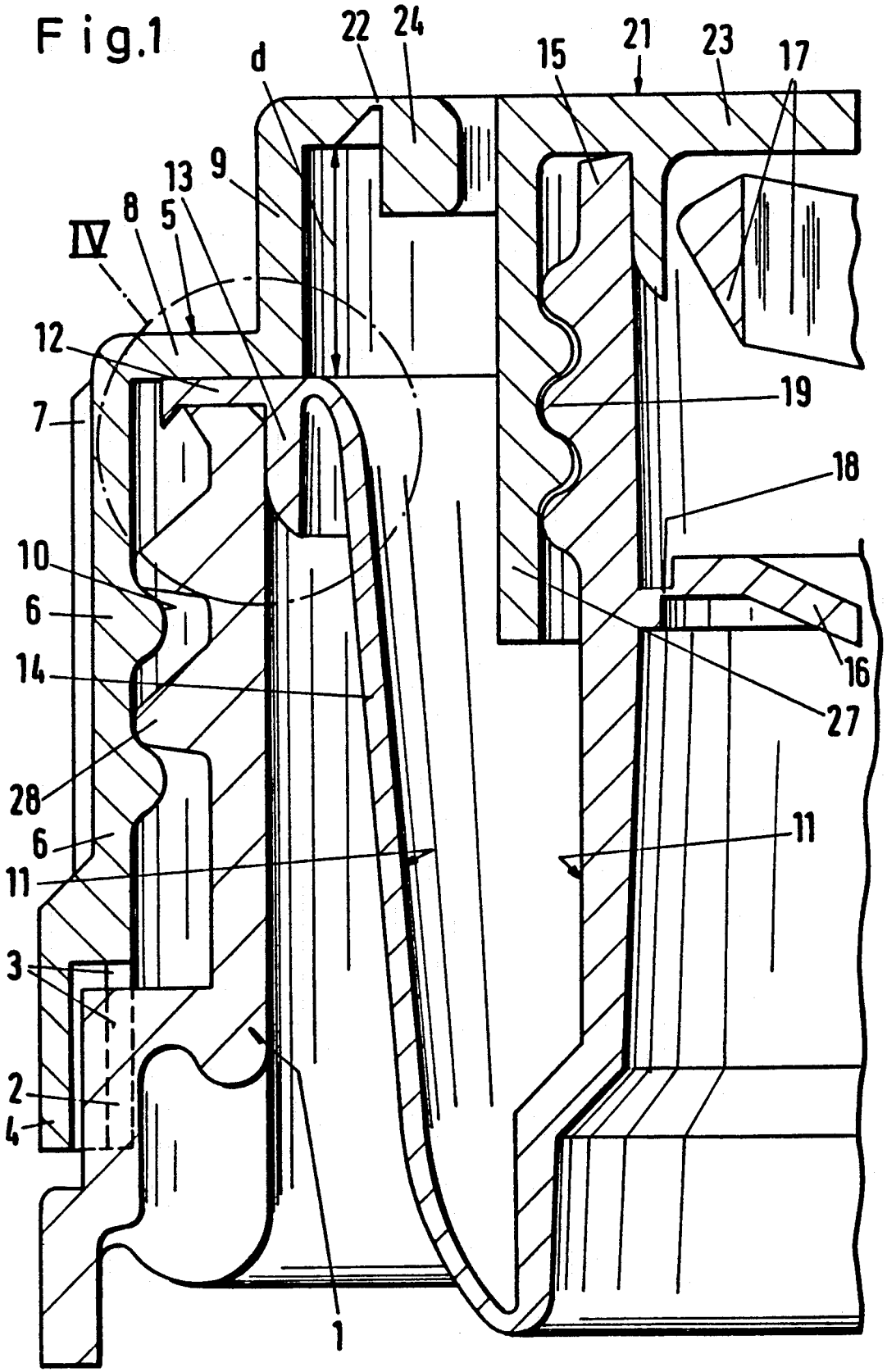
FIG. 1 is a fragmentary cross-sectional view of a plastic closure according to the invention with the neck of the container closed, and is the section taken along the line B—B in FIG. 3.

The embodiments illustrated in the drawings show a plastic closure to seal a plastic can containing, e.g. motor oil.

The neck of the can, shown generally at 1, has toothing in the region 2 for engagement with locking clips 3 for fixing the security strip 4 on the screw-on ring, shown generally at 5. The ring 5 comprises a cylindrical wall 6 with external ribbing 7 on the one hand and a bracket 8 on the other. The security strip 4 of the screw-on ring 5 is mounted at the bottom of the ring, i.e. at the side towards the can or in the direction of the interior of the can as seen from outside.

Figure 2:
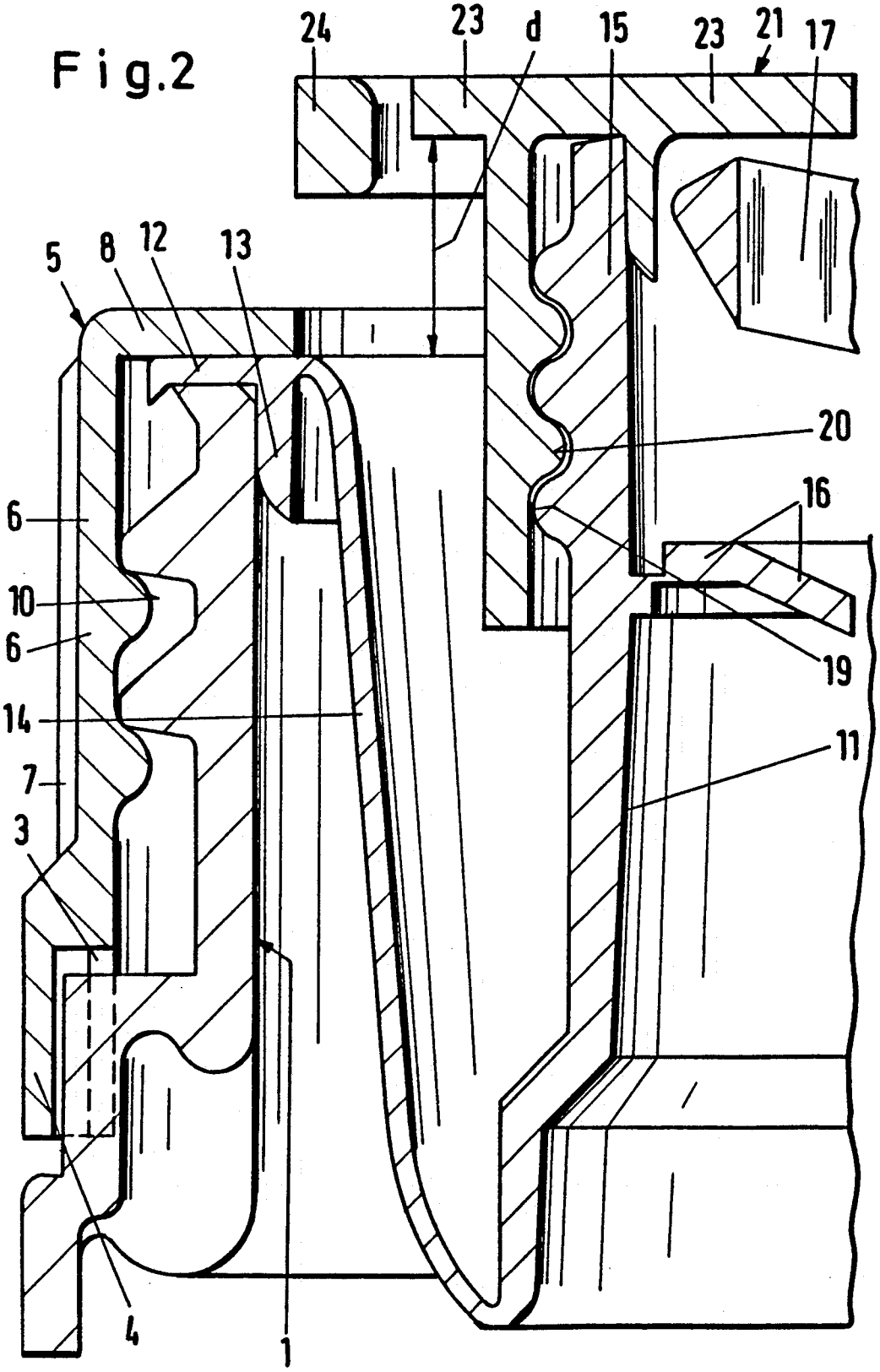
FIG. 2 is similar to FIG. 1, but with the cross-section taken along the line A—A in FIG. 3.

Two arcuate retaining pieces 9 diametrically opposite one another are moulded on externally, i.e. at the top in FIGS. 1 and 2 or at the side furthest away from the interior of the can.

The plastic closure largely comprises two parts, namely the screw-on ring 5 already described, made of a harder plastic with thick walls to give the internal thread 10 adequate stability; and a second, flexible part, preferably made of polyvinyl acetate, and described generally as the insert portion 11.

Figure 4:
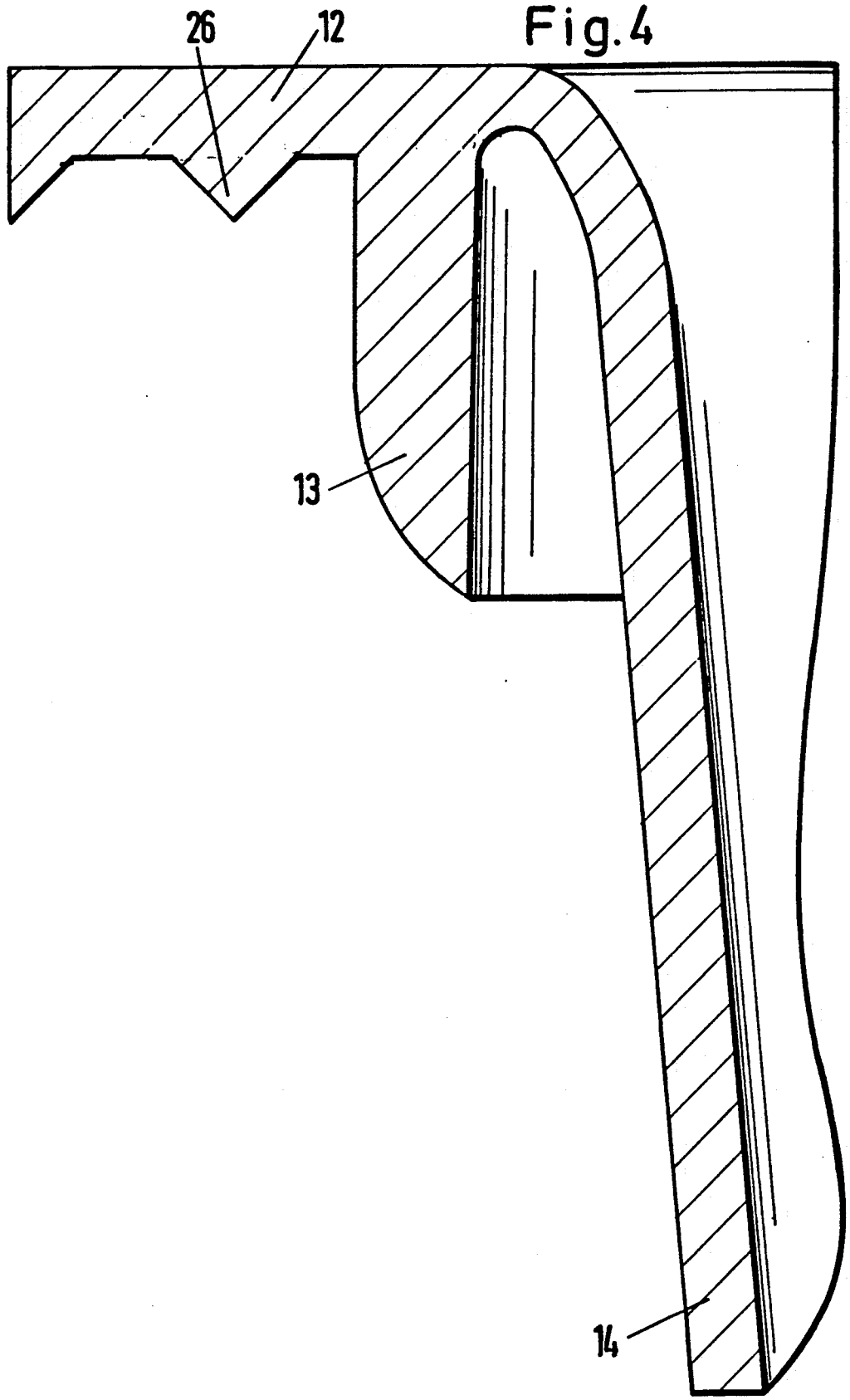
FIG. 4 is an enlarged an cut out cross-sectional view of the dash and dot line circle IV in FIG. 1, with the screw-on ring and the neck of the container omitted.

The insert portion 11 in turn comprises the sealing flange 12, the annular sealing cone 13 integral therewith, the flange and cone together forming an L-shape in cross-section as will be seen from FIGS. 1, 2 and 4, the flexible bellows 14 extending from and integral with the point where the two limbs of the L join, and the outer part forming the pour spout 15; the spout has the security seal 16 with pulling strip 17 moulded onto the inside and linked with a circular, predetermined breaking line 18, and is provided with external thread 19 on the outside.

The cap shown generally at 21, which is integral with the screw-on ring 5, is screwed onto the external thread 19 by means of a matching internal thread 20.

The screw-on ring 5 and the cap 21 are integrally connected by two arcuate, diametrically opposed tear strips 22. Each particular strip is directly connected to the arcuate retaining pieces 9 near the surface of the top wall 23 of the cap 21. It will be seen from FIG. 1, where the tear strip 22 is shown narrowed down in cross-section to provide a predetermined breaking line, how the retaining piece 9 is also L-shaped in cross-section, in such a way that adjoining the top wall 8 of the ring 5 a cylindrical portion projects upwardly and outwardly whilst the other limb, located approximately at the level of the top wall 23 of the cap 21, joins on from there and ends in the above-mentioned tear strip 22.

Figure 3:
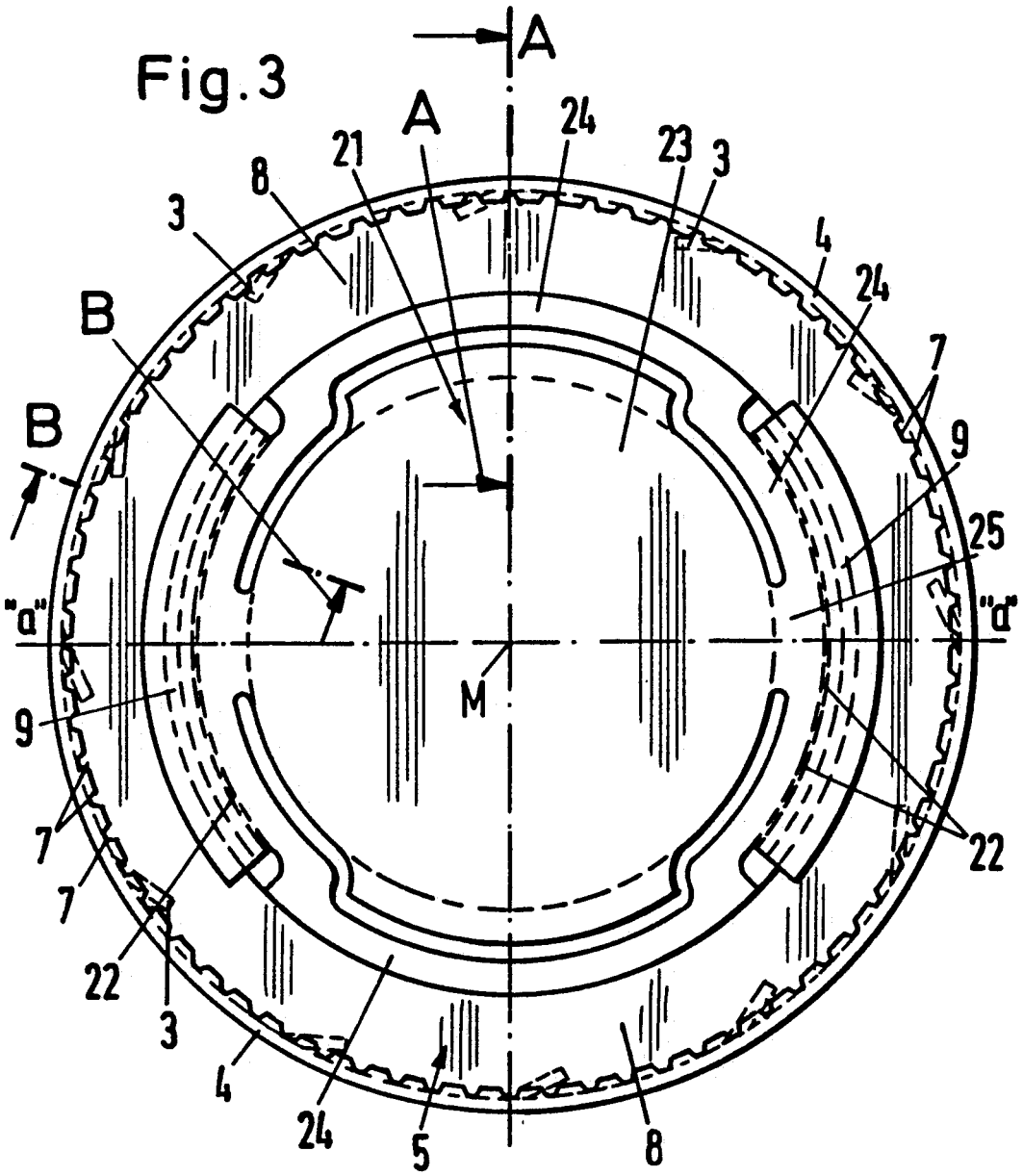
FIG. 3 is a plan view of the plastic closure with some internal parts shown in broken lines.

The material of the frame 24 of the frame cap 21 is shown adjacent the tear strip 22 in the direction of the center point M (FIG. 3). The two frames 24, which are completely visible from above in FIG. 3, are identical in mirror image and are linked in the region 25 to the top wall 23 of the cap 21, in the region of the axis and which extends through the centre point M. It can be seen clearly from FIG. 2, which is a section along the line A—A in FIG. 3 that the frame 24 extends freely outwardly without any direct connection (in this part of the longitudinal section) to the screw-on ring 5. On the other hand the frame 24 is connected by the tear strip 22 in the region of the arcuate retaining pieces 9 (as shown in section in FIG. 1).

Hence the user cannot readily take hold of the frames 24 from the outside in the region of the retaining pieces 9, and for this reason the linking region 25 is provided in the region of the retaining pieces, midway along them as shown in FIG. 3. However it is quite possible to take hold of the frames 24 in both positions offset through 90° from the coupling region 25, because at this position the frames 24 are unimpeded as shown in FIG. 2.

Thus the important innovation in the embodiment of the plastic closure shown in FIGS. 1 to 3 is the two part embodiment, one part being the insert portion 11 and the other the screw-on ring 5, with the frame cap moulded to the top of the ring via the two arcuate tear strips 22 in the course of the same production process and using the same plastic material. The screw-on ring 5 and frame cap 21 could together be described as a "screw-on cap".

In the plan view in FIG. 3 the arcuate retaining pieces 9 have a segmental shape. In cross-section they have the L-shape shown in FIG. 1. The web 9 extending in the direction of the axis of the pour spout 15 has a height d which keeps the lower surface of the top wall 23 of the of the cap 21 some distance away from the lower surface of the top wall 8 of the ring 5. This is why the spacing d also appears in FIG. 2.

If the spacing d were zero, i.e. if the top wall 23 of the cap 21 were at the same level as the top wall 8 of the ring 5, then the user would have no way of taking hold of the frames 24 without using tools. Apart from this obvious drawback there would be the further disadvantage that, if the ring 5 were taken hold of automatically and screwed onto the neck 1 of the container, radial forces would be transferred directly to the tear strips 22, with the result that the strips 22 would be completely or partially damaged during the mounting of the closure. But the fact that the limb of the L-shaped retaining piece 9 projects outwardly and upwardly means that a link is provided where this limb or retaining piece 9 is joined to the radially inner edge of the top wall 8 of the ring 5. During opeation, this link absorbs the radial forces imposed by the automatic tool as it engages the screw-on ring, thus either changing the disposition of the horizontal top wall 8 and the vertical cylindrical section of the piece 9, or changing the angle between these two walls, which are normally approximately perpenduclar to one another. So damage or tearing open of the strips 22 during assembly is advantageously avoided.

It will further be seen from FIGS. 1, 2 and 4 that a sealing flange 12 is moulded onto the insert portion 11 at the side of the flexible bellows 14 opposite the pour spout 15. It may be made of the same soft, flexible plastic material as the bellows 14. Thus the flange 12 is similarly flexible and resiliently yielding. If it is inserted between the end surface of the neck 1 of the container and the lower or inner surface of the top wall of the ring 5, as shown in FIGS. 1 and 2, and compressed by tightening the screw-on ring through engagement of the thread 10, a reliable seal is obtained, which is circular in the embodiment illustrated.

Should there by any damage to the end annular surface of the neck 1 of the container during production, so that the flange 12 does not always provide a satisfactory seal, then the definite sealing function is provided by a sealing cone 13 made of the same material as the flange 12 and flexible bellows 14. The cone 13 is also annular and is moulded integrally onto the flange and with the bellows 14, at the place where these two parts join.

Whereas the flange 12 is arranged in a substantially horizontal plane, i.e. in the plane of the end ring on the neck 1, the wall of the cone 13 extends perpendicularly thereto and has at least one surface parallel to the inner like sleeve surface of the neck 1. The cone 13 is in close contact with this surface of the neck from the inside, so that a dual sealing function is provided by the flange 12 and the cone 13.

FIG. 4 shows an alternative to FIGS. 1 and 2, in the form of a sealing flange 12 which additionally has an annular projection 26. During asembly in accordance with FIGS. 1 and 2, the projection is laid on the end annular surface of the neck 1 and thus provides a reliable annular seal. It is also possible for the trianglar profile of the projection 26 shown in FIG. 4 to have a different shape, e.g. circular, oval, polygonal or the like.

In operation, the production of such a closure is firstly much simpler. The first part, comprising the screw-on ring 5 and the frame cap 21, is moulded from a first plastic material. The second part comprising insert portion 11 with the sealing flange 12, sealing cone 13, flexible bellows 14 and pour spout 15, is moulded from a second, softer plastics material. The security seal 16 with the tear off line 18 and pulling strip 17 is obviously moulded integrally with the insert portion 11.

When assembling the closure, the screw-on ring 5 and frame cap 21 are picked up and, when the insert portion 11 has been placed on the neck 1 of the container, mounted, firstly so that the cylindrical wall 7 of the cap 21 with the internal thread 20 engages the external thread 19 of the pour spout 15; secondly so that the internal thread 10 on the cylindrical wall 6 of the cap 5 engages the external thread 28 of the neck 1; and thirdly so that the clips 3 are moved into the security seal position with the toothing 2 on the neck 1. Thus the container is sealed and the security closure mounted.

To open the container the user takes hold of the frames 24 without requiring any tools, pulls them upwards to open the can, along the tear strips 22 until the breaking lines in the strips 22 reach the link region 25. He now pulls both raised frames 24 further upwardly and outwardly in the direction of the axis of the spout 15 and away from the centre point of the can. Consequently the strip 22 also tears away in the region of the link 25, so that the cap 21 is separated from the ring 5. The user can then pull the central part, comprising the flexible bellows 14 and spout 15 together with the cap 21 upwardly away from the now detached ring and the neck of the container 1. During this final movement the flexible bellows 14 turn inside out in known manner.

The user can now finally unscrew the cap 21, disengaging the thread 19 and 20. He then takes hold of the pulling strip 17 and tears out the security seal 16 along the circular breaking line 18. The container is now open and its contents can be poured out in a well directed jet through the long spout formed by the now inside out bellows portion 14 and the neck 11.

I claim:

1. A plastic closure adapted to be screwed onto the neck (1) of a plastic container with a screw-on ring (5) and with an insert portion (11) comprising a flexible bellows (14) and a pour spout (15), with frame cap (21) adapted to be screwed on to an external thread (19) on the spout, characterized in that the frame cap (21) is integral with the screw-on ring (5), and the top wall (23) of the cap (21) is moulded so that it projects a distance (d) from the top wall (8) of the ring (5), said top wall (8) of said ring (5) provided with at least one raised, outwardly protruding retaining piece (9) of a height approximately equal to the distance (d) to the top wall (23) of the cap (21).

2. The closure of claim 1, characterised in that the cap (21) is connected to the ring (5) by a tear strip (22).

3. The closure of claim 1, characterised in that the top wall (8) of the ring (5) is provided with at least one raised, outwardly protruding retaining piece (9) of a height approximately equal to the distance (d) to the top wall (23) of the cap (21).

4. The closure of claim 3, characterized in that the retaining piece (9) is shaped as a segment of a circle in plan.

5. The closure of claim 3, characterized in that the top wall (8) of the ring (5) is provided with two diametrically opposed, arcuate retaining pieces (9) molded into the ring (5), and tear strips (22) extend radially inward from the retaining pieces (9), following their curvature.

6. The closure of claim 1, characterized in that a sealing flange (12) is molded onto the insert portion (11) at the side of the flexible bellows (14) opposite the pour spout (15).

7. The closure of claim 6, characterized in that a sealing cone (13) is mounted on the sealing flange (12).

8. The closure of claim 6, characterized in that an annular projection (26) is mounted on the surface of the sealing flange (12) facing towards the neck (1) of the container.

9. The closure of claim 1, characterized in that the ring (5) is made of a relatively hard plastic.

10. The closure of claim 1, characterized in that the ring (5) has locking clips (3) which preclude the removal of ring (5) from neck (1).

11. The closure of claim 9, wherein a sealing cone (13) is mounted on the sealing flange (12).

12. The closure of claim 9, wherein an annular projection (26) is mounted on the surface of the sealing flange (12) facing towards the neck (1) of the container.

13. A plastic closure adapted to be screwed onto the neck (1) of a plastic container with a screw-on ring (5) and with an insert portion (11) comrpising a flexible bellows (14) and a pour spout (15), with frame cap (21) adapted to be screwed on to an external thread (19) on the spout, characterized in that the frame cap (21) is integral with the screw-on ring (5), and the top wall (23) of the cap (21) is moulded so that it projects a distance (d) from the top wall (8) of the ring (5), said cap (21) connected to the ring (5) by a tear strip (22), the top wall (8) of the ring (5) provided with at least one raised, outwardly protruding retaining piece (9) of a height approximately equal to the distance (d) to the top wall (23) of the cap (21).

14. The closure of claim 13, wherein a sealing flange (12) is moulded onto the insert portion (11) at the side of the flexible bellows (14) opposite the pour spout (15).

15. The closure of claim 13, wherein the ring (5) is made of relatively hard plastic.

16. The closure of claim 13, wherein the ring (5) has locking clips (3) which preclude the removal of ring (5) from neck (1).

17. A plastic closure adapted to be screwed onto the neck (1) of a plastic container, said closure comprising a screw-on ring (5) with means for securing said screw-on ring (5) to an external thread (29) of a container neck (1), an insert portion (11), and a frame cap (21), said insert portion comprising a flexible bellows (14) and a pour spout (15), said frame cap (21) screwed onto an external thread (19) on the spout (15), said frame cap

(21) being integral with said screw-on ring (5), said cap (21) havin a top wall (23) a distance (d) above the ring top wall (8), said ring top wall (8) having protruding outwardly therefrom a retaining piece (9), said retaining piece (9) having extending radially inwardly therefrom tear strips (22).

18. The closure of claim 17 characterized in that the insert portion (11) also comprises a sealing flange (12) having an annular sealing cone (13) integral therewith.

* * * * *